US005902170A

United States Patent [19]

Ganz

[11] Patent Number: 5,902,170

[45] Date of Patent: May 11, 1999

[54] BODY SHAPING UNDERGARMENT

[75] Inventor: Nancy Ganz, New York, N.Y.

[73] Assignee: Warnaco Inc., New York, N.Y.

[21] Appl. No.: 08/450,549

[22] Filed: May 25, 1995

[51] Int. Cl.[6] ..... A41B 9/00; A41C 1/00

[52] U.S. Cl. ..... 450/94; 450/100; 450/106; 450/132; 450/155; 2/311; 2/406

[58] Field of Search ..... 2/300, 301, 302, 2/303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338; 450/131, 132, 100, 106, 107, 111, 154, 155, 74

[56] References Cited

U.S. PATENT DOCUMENTS

| | | | |
|---|---|---|---|
| 1,912,664 | 6/1933 | Smith | 450/106 |
| 2,040,557 | 5/1936 | Kops et al. | 450/131 X |
| 2,064,977 | 12/1936 | Kahn | 450/111 |
| 2,149,149 | 2/1939 | Scheinberg | 450/111 |
| 2,300,154 | 10/1942 | Herbener | 450/111 |
| 2,862,503 | 12/1958 | Blatt | 450/111 X |
| 2,899,964 | 8/1959 | Beune | 450/155 X |
| 2,904,048 | 9/1959 | Schamber | 450/132 X |
| 2,955,598 | 10/1960 | Blatt . | |
| 3,080,868 | 3/1963 | Zanca | 450/132 |
| 3,148,682 | 9/1964 | Cousins | 2/306 |
| 3,221,749 | 12/1965 | Marino | 450/132 X |
| 3,512,532 | 5/1970 | Sutter . | |

FOREIGN PATENT DOCUMENTS

| | | | |
|---|---|---|---|
| 110490 | 4/1940 | Australia | 450/106 |
| 570950 | 12/1957 | Italy | 450/154 |

*Primary Examiner*—Jeanette Chapman

*Attorney, Agent, or Firm*—Amster, Rothstein & Ebenstein

[57] ABSTRACT

An undergarment is disclosed having a front fabric panel and a back fabric panel fixed together to form an undergarment having a hollow tubular shape. The undergarment is open at a top end to define an open waist opening and open at a bottom end to define an open hip opening. The front fabric panel has a width longer than a width of the back fabric panel. An elastic waist band having a width of at least one and one-half inches is disposed around the circumference of the waist opening. The elastic waist band has an elasticity effective to constrain and shape the waistline of a wearer. A pair of elastic leg straps are disposed at the hip opening. Each elastic leg strap has a first end fixed to the front fabric panel and a second end fixed to the back fabric panel. The pair of elastic leg straps are disposable during use between legs and around a crotch area of a user, so that each elastic leg strap extends from the front fabric panel, between the legs of the user, around the crotch area of the user and to the back fabric panel to retain the undergarment at a position against a waist and a mid-section of the user. An elastic hip band is disposed around a circumference of the hip opening for co-acting with the front fabric panel, the back fabric panel and the elastic waist band to shape the waist and mid-section of the user.

9 Claims, 8 Drawing Sheets

BODY SHAPING UNDERGARMENT

TECHNICAL FIELD

The present invention pertains to undergarments worn around the waist, hips, buttocks and thighs of a wearer. In particular, the present invention pertains to an undergarment for firming and shaping the tummy, thighs, hips and buttocks of the wearer.

BACKGROUND

A conventional undergarment, such as a panty or brief, is comprised of a number of fabric panels sewn together to form an undergarment having two leg openings and a waist opening. The undergarment is worn by slipping each of the legs of the wearer through the waist opening and through a respective leg opening. The undergarment is then pulled up the legs and disposed so as to cover the waist, hips, buttocks and thighs of the wearer. Traditionally, elastic material may be sewn to the undergarment at the circumference of the waist opening and/or leg openings to provide a snug, flexible fit of the garment on the body of the wearer.

Generally, the elastic material consists of a light, thin elastic band sewn to the undergarment at the circumference of the waist opening and/or leg openings, and is very easily stretched to conform to the body of the wearer and to allow for comfort and ease of movement. The elastic material provides very little support, and is usually ineffective for shaping and firming the body of the wearer. Also, the material used for the fabric panels is usually relatively light weight and non-supportive of the body of the wearer.

Body-shaping undergarments have been designed to satisfy the desire of a wearer to present a firm and shapely figure. A conventional body-shaping undergarment is exemplified by a corset. A corset is a shaped, close-fitting, usually reinforced undergarment worn to shape and support the body of the wearer. A conventional body-shaping undergarment typically utilizes stiff and overly-constraining reinforcing components and straps, making the garment clumsy, uncomfortable and severely restrictive of the movement of the wearer.

FIGS. 8 and 9 show a prior attempt at providing a body-shaping undergarment that is comfortable to wear and not overly restrictive. This body-shaping undergarment comprises a plurality of fabric panels sewn together to define waist opening 1 and leg openings 2. The circumference of the waist opening 1 is bordered by an elastic waist band 3, which is designed to support and firm the midsection of the wearer. The circumference of each leg opening 2 is bordered by a thin elastic leg band 4 for drawing the leg openings 2 of the garment close around the thighs of the wearer. A pair of straps 5 are fixed to the front and back of each leg opening 2, and each strap 5 terminates in a fitting for attachment to hosiery worn by the wearer. As shown in FIG. 9, a pair of buttock support panels 6 are disposed at the back-side of the undergarment. Each buttock support panel 6 supports and shapes a respective buttocks of the wearer, and a large gap 7 is present between the buttock support panels 6 with no fabric panel existing to cover the buttock of the wearer.

The undergarment shown in FIGS. 8 and 9 suffers from a number of drawbacks that makes it less than effective to adequately shape and firm the body of the wearer. For example, the thin elastic leg bands 4 provide very little support to the thighs of the wearer. Also, the large gap 7 between the buttock support panels 6 reduces the comfort of the wearer, requiring the use of an additional undergarment, such as a panty, to adequately cover the buttocks of the wearer. Also, due to the large gap 7, and the inability of the thin elastic leg bands 4 to adequately support the thighs of the user, the undergarment lacks the co-action between the leg bands 4, buttock support panels 6 and waist band 3 that is necessary to effectively shape and support the mid-section of the wearer.

There have been a variety of attempts to provide a body-shaping undergarment capable of shaping and supporting the body of the wearer. For example, U.S. Pat. No. 5,255,393, issued to Brady, discloses a form fitting undergarment to be worn by pregnant women or women with large abdomens. To accommodate a large abdomen, this reference teaches the use of a front panel made of a stretchable material that is more stretchable than to other fabric panels making up the undergarment. This prior attempt fails to adequately constrain and support the mid-section of the wearer, and is thus ineffective at providing a firmer, more shapely figure.

Also, U.S. Pat. No. 4,390,999, issued to Lawson et al., discloses a panty hose type garment having a body bulge controlling portion. The body bulge controlling portion is provided so that a compressive force exerted by the garment against the body is varied in a stepped manner. This prior attempt does also fails to adequately constrain and support the waist and mid-section of the wearer, and thus fails to provide a body-shaping undergarment that is comfortable to wear and effective at firming and shaping the mid-section of the wearer.

SUMMARY OF THE INVENTION

The invention, as claimed, is intended to provide a remedy. It solves the problem of how to provide a body-shaping undergarment that is comfortable to wear and effective at firming and shaping the mid-section of the wearer.

In accordance with the present invention, an undergarment is provided having a front fabric panel and a back fabric panel fixed together to form an undergarment having a hollow tubular shape. The undergarment is open at a top end to define an open waist opening and open at a bottom end to define an open hip opening. The front fabric panel has a width longer than a width of the back fabric panel. An elastic waist band having a width of at least one and one-half inches is disposed around the circumference of the waist opening. The elastic waist band has an elasticity effective to constrain and shape the waistline of a wearer. A pair of elastic leg straps are disposed at the hip opening. Each elastic leg strap has a first end fixed to the front fabric panel and a second end fixed to the back fabric panel. The pair of elastic leg straps are disposable during use between legs and around a crotch area of a user, so that each elastic leg strap extends from the front fabric panel, between the legs of the user, around the crotch area of the user and to the back fabric panel to retain the undergarment at a position against a waist and a mid-section of the user. An elastic hip band is disposed around a circumference of the hip opening for co-acting with the front fabric panel, the back fabric panel and the elastic waist band to shape the waist and mid-section of the user.

Preferably, the front fabric panel and the back fabric panel comprise an elastic fabric comprising 59% dull antron nylon, 23% mid dull antron nylon and 18% dull lycra. Also, preferably the width of the elastic waist band is two inches to adequately constrain and shape the waistline and midsection of the wearer.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
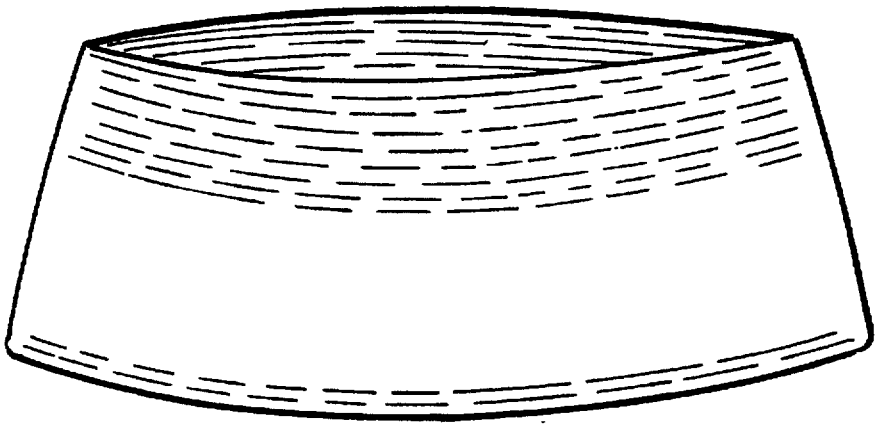
FIG. 1 is a front perspective view of the inventive body shaping undergarment; in accordance with one embodiment of the present invention.

Referring to FIG. 1, an embodiment of the inventive body shaping undergarment is shown. The inventive body shaping undergarment comprises a front fabric panel 10, and a back fabric panel 12, that are fixed together to form the inventive undergarment. The inventive body shaping undergarment has a hollow tubular shape that is open at its top end to define an open waist opening 14, and is also open at its bottom end to define an open hip opening 16. An elastic waist band 18 is disposed around the circumference of the waist opening 14. The elastic waist band 18 has an elasticity and a width that is effective to constrain and shape the waistline of a wearer. Thus, in accordance with the present invention, a body shaping undergarment is provided having a hollow tubular shape.

In use, the wearer disposes the inventive body shaping undergarment around his or her waistline and midsection so that the elastic waist band 18 exerts a compressing force against the waist and the midsection of the wearer, to thereby draw in and shape the body of the wearer. The front and back fabric panel 12*s* preferably have an elasticity so as to also exert a compressing force against the body of the wearer to shape the midsection, thereby providing, in conjunction with the elastic waist band 18, a means for effectively shaping and firming the waistline and midsection of the wearer. Preferably, the front fabric panel 10 and/or the back fabric panel 12 comprise an elastic fabric comprised of 59% dull antron nylon, 23% mid-dull antron nylon and 18% dull lycra. This fabric composition has the desired elastic characteristics so that the inventive body shaping undergarment is effective for shaping and firming the waistline and midsection of the wearer.

In order to exert a comfortable and effective compressing force on the waistline of the wearer, the elastic waist band 18 has a width of at least 1 and ½ inches, and preferably has a width of 2 inches. By this construction, the elastic waist band 18 exerts its compressing force over an area of the wearer's waistline that is large enough to promote comfort, while concentrating the constraining effects of the elastic waist band 18 where appropriate, namely the waistline of the wearer. In the embodiment shown in FIG. 1, a thin elastic hip band 20 is disposed around the circumference of the open hip opening 16. This thin elastic hip band 20 helps to maintain the inventive body shaping undergarment in position on the wearer's body. The front fabric panel 10, the back fabric panel 12, the elastic waist band 18 and the elastic hip band 20 are fixed together using an appropriate fastening method, such as stitching, gluing, or the like. Preferably, stitching is used to fix the front fabric panel 10, back fabric panel 12, elastic waist band 18 and elastic hip band 20 together to form the inventive body shaping undergarment.

Figure 2:
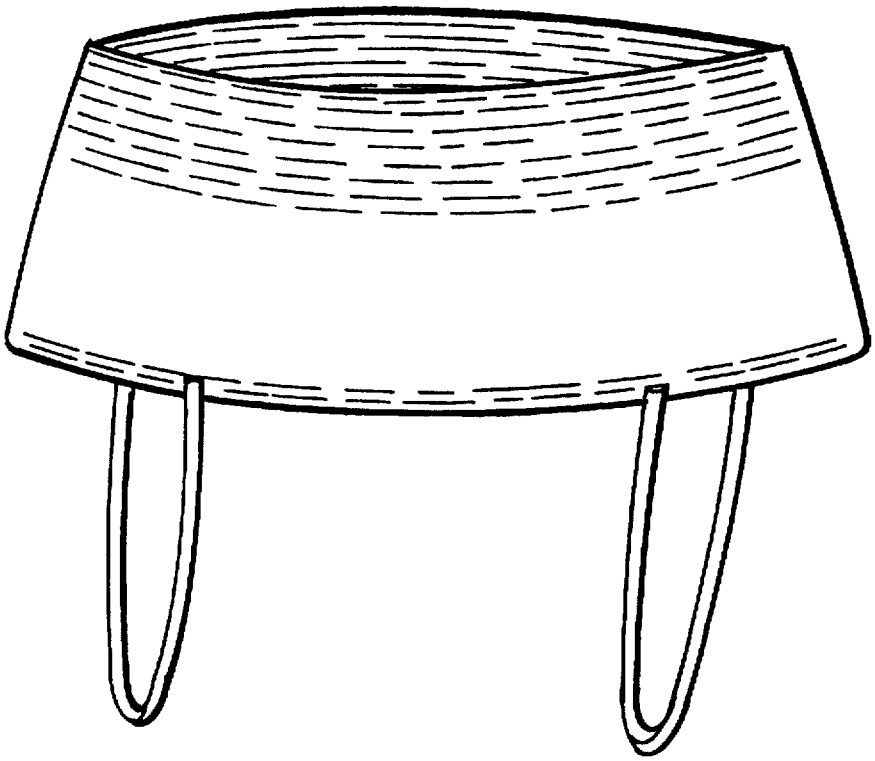
FIG. 2 is a front perspective view of the inventive body undergarment in accordance with another embodiment of the present invention.

As shown in FIG. 2, in accordance with another embodiment of the inventive body shaping undergarment, a pair of leg straps 22 are disposed at the hip opening 16. Each leg strap has a first end fixed to the front fabric panel 10, and a second end fixed to the back fabric panel 12. The pair of leg straps 22 are disposable during use between the legs and around the crouch area of the wearer, so that each leg strap extends from the front fabric panel 10, between the legs of the user, around the crouch area of the user and to the back fabric panel 12 (shown in FIG. 5). By this construction, the inventive body shaping undergarment is retained at a position against the waist and midsection of the wearer, so that the front fabric panel 10, the back fabric panel 12 and the elastic waist band 18 co-act to shape the waist and midsection of the user.

Figure 3:
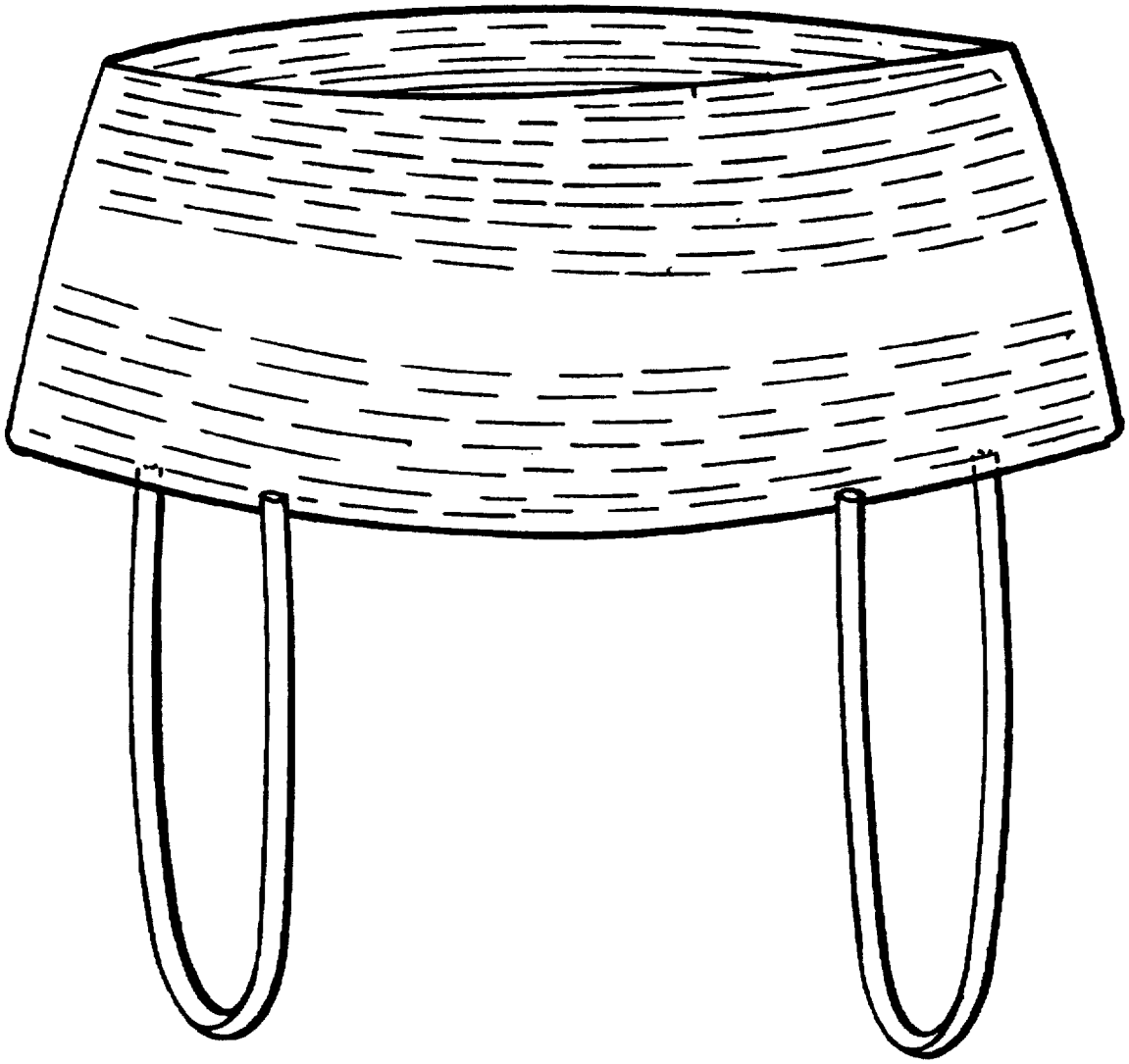
FIG. 3 is a front perspective view of the inventive body shaping undergarment in accordance with yet another embodiment of the present invention.

FIG. 3 shows yet another embodiment of the inventive body shaping undergarment. In accordance with this embodiment, a wide elastic hip band 20 is disposed around the circumference of the open hip opening 16. This wide elastic hip band 20 provides a larger compressing surface area against the buttocks, hips and thighs of the wearer, to promote comfort and to effectively constrain the body of the wearer to present a firmer and more shapely figure. The wide elastic hip band 20 is preferably two inches in width, and also helps to maintain the inventive body shaping undergarment in position on the body of the wearer, so that it is effective to firm and shape the waistline and midsection of the wearer. As shown in FIG. 3, the pair of elastic leg straps 22 may be provided to maintain the position of the undergarment, or alternatively the leg straps 22 may be excluded.

Figure 4:
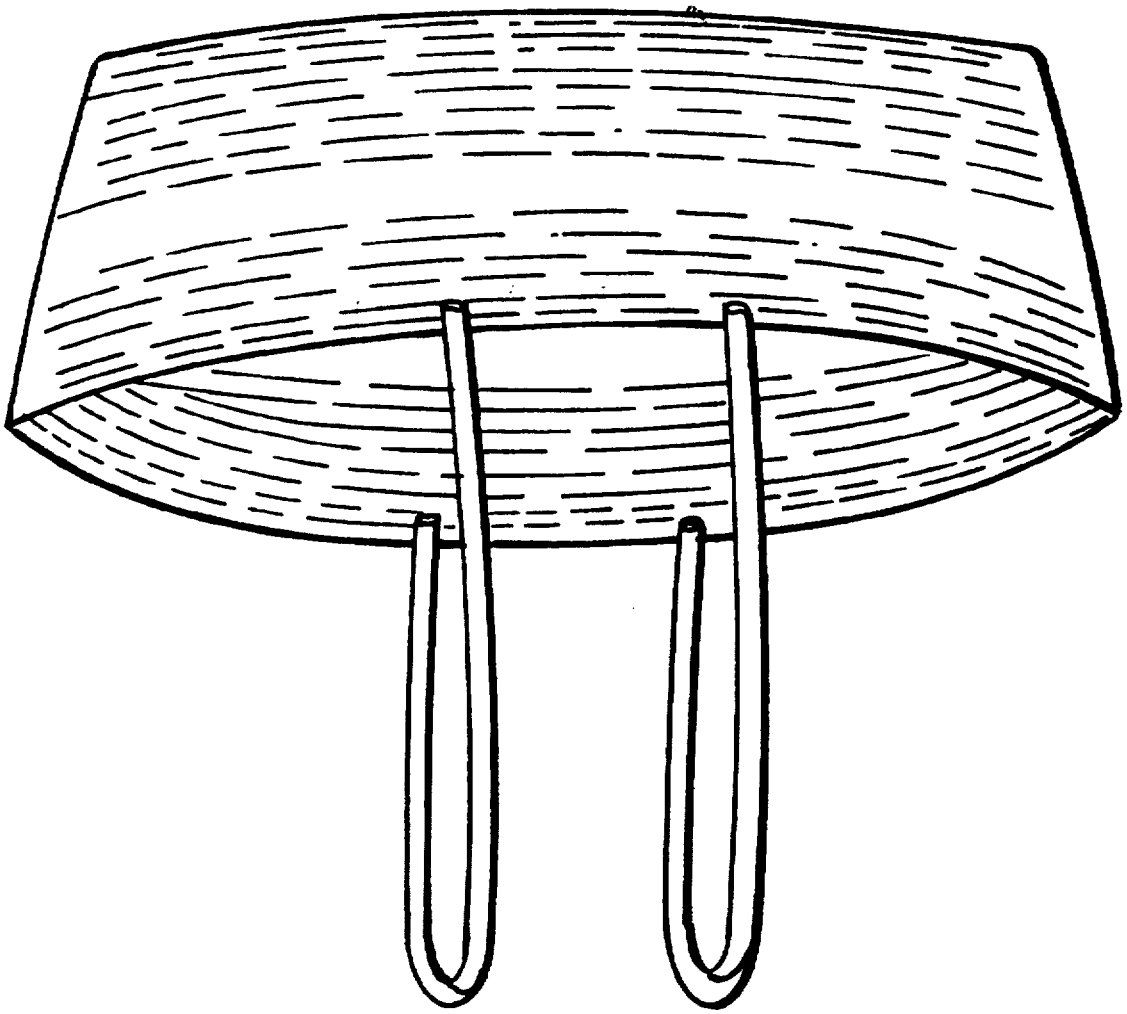
FIG. 4 is a rear back perspective view of the embodiment of the inventive body shaping undergarment shown in FIG. 3.

Referring to FIG. 4, a back view of the embodiment of the inventive body shaping undergarment is shown. As shown, preferably the front fabric panel 10 has a width that is longer than the width of the back fabric panel 12. By this construction, the compressing force of the inventive body shaping undergarment is focused at the waistline and midsection of the wearer, so as to firm and shape these typical problem areas of the body. The larger area of the front fabric panel 10 insures that the waistline and tummy area of the wearer are adequately constrained by the inventive body shaping undergarment, so that when the inventive body shaping undergarment is worn, a firmer more shapely figure is provided.

Figure 5:
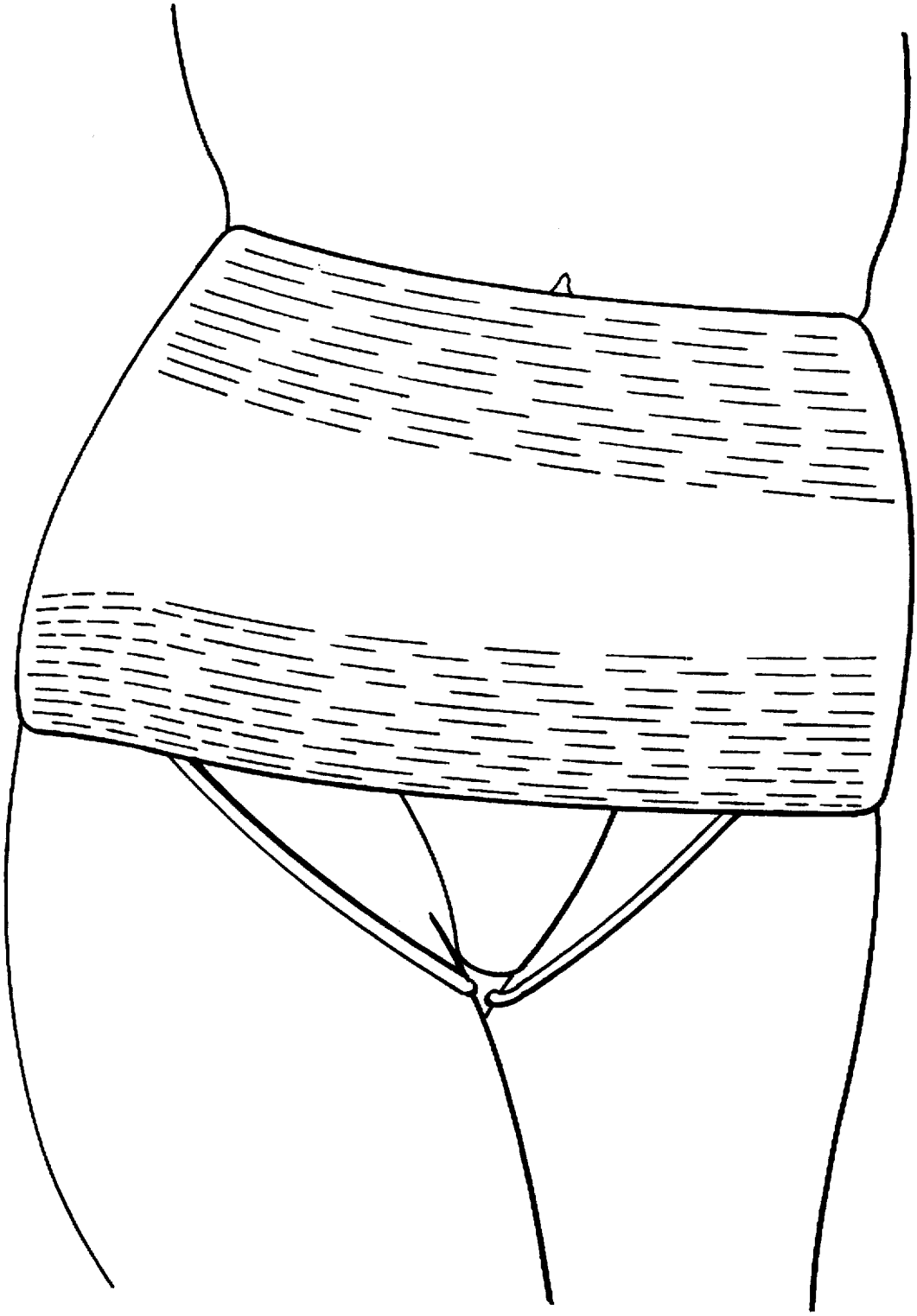
FIG. 5 illustrates the embodiment of the inventive body shaping undergarment shown in FIG. 3, in use.

FIG. 5 shows the inventive body shaping undergarment as worn by a wearer. The inventive body shaping undergarment is disposed on the wearer's body by placing the feet through the open waist opening 14 and pulling the inventive body shaping undergarment up over the legs so that the elastic leg straps 22 are disposed between the legs of the wearer. As shown, once the inventive body shaping undergarment is in place, the pair of elastic leg straps 22 are disposed between the legs and around the crouch area of the user, so that each elastic leg strap extends from the front fabric panel 10, between the legs of the user, around the crouch area and to the back fabric panel 12. Thus, the inventive body shaping undergarment is retained at a position against the waist and midsection of the user so as to be effective for shaping the body of the wearer.

Figure 6:
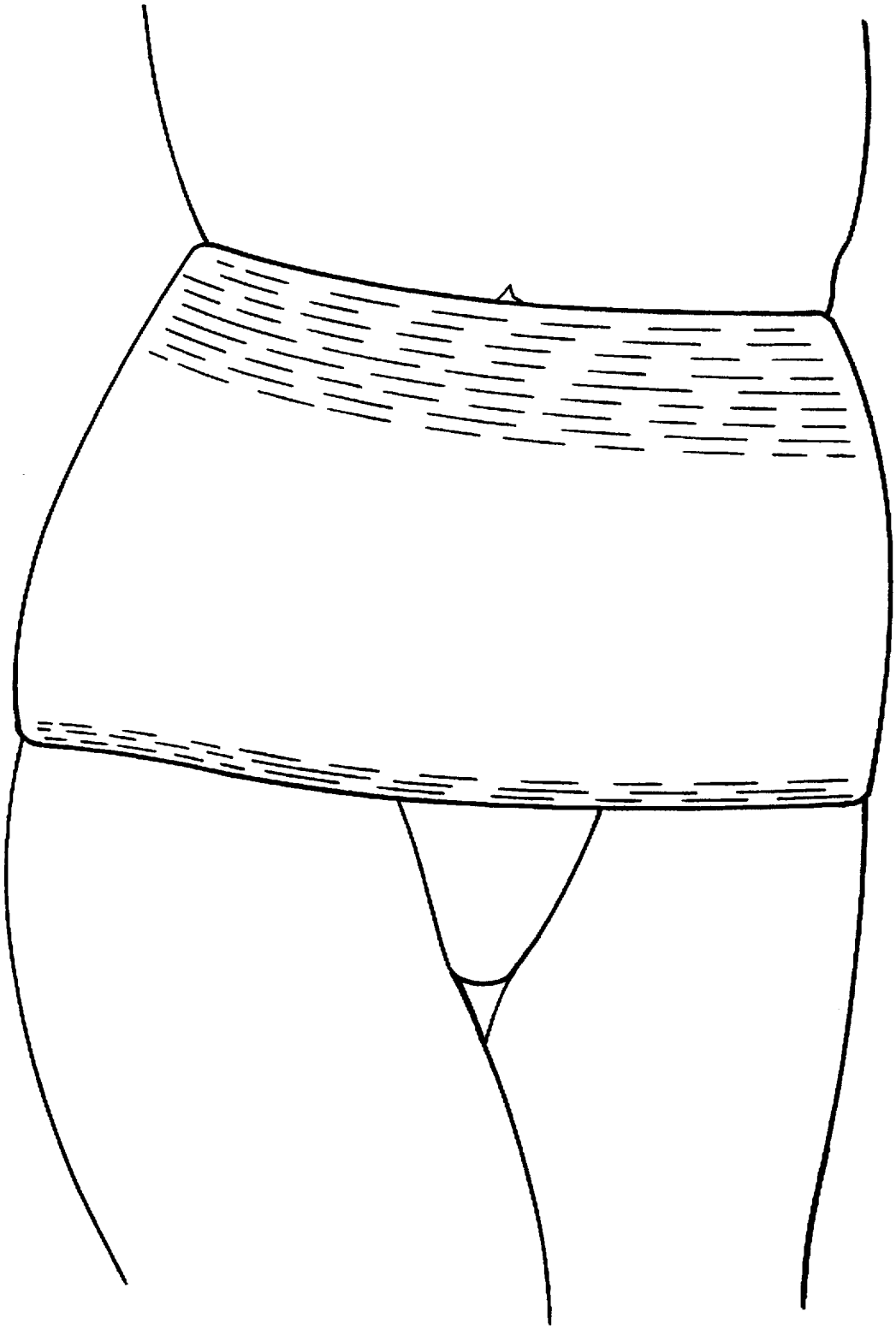
FIG. 6 illustrates the embodiment of the inventive body shaping undergarment shown in FIG. 1, in use.

FIG. 6 shows the use of the embodiments of the inventive body shaping undergarment that do not include the leg straps 22. As shown, the inventive body shaping undergarment is disposed around the waistline and midsection of the wearer so that the wide elastic waist band 18 exerts a compressing force around the waistline of the user, while the front and back fabric panel 12 co-act with the wide elastic waist band 18 to shape and firm the waistline and midsection of the wearer. In accordance with the construction of the inventive body shaping undergarment, an easy to put on, comfortable to wear, and effective body shaping undergarment is provided. The inventive body shaping undergarment may be worn over the panties or panty hose of the wearer, and thus helps to smooth out and eliminate any panty lines which may typically be visible through the outer clothing of the wearer. Also, by smoothing and shaping the body of the wearer, the inventive body shaping undergarment allows the wearer to obtain a slimmer, more a attractive figure.

Figure 7:
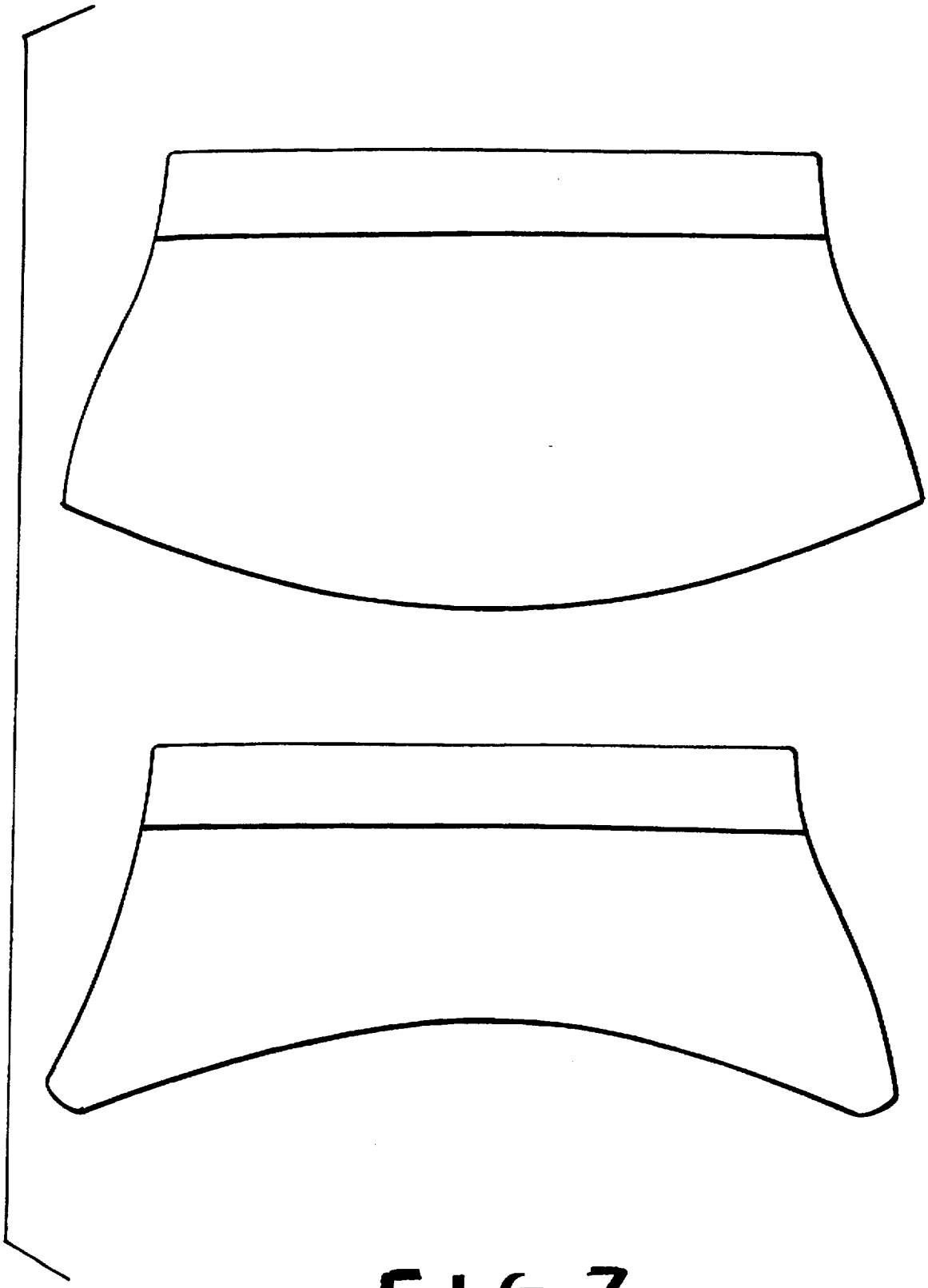
FIG. 7 is a splayed out plan view of the fabric panels comprising the inventive body shaping undergarment.
Figure 8:
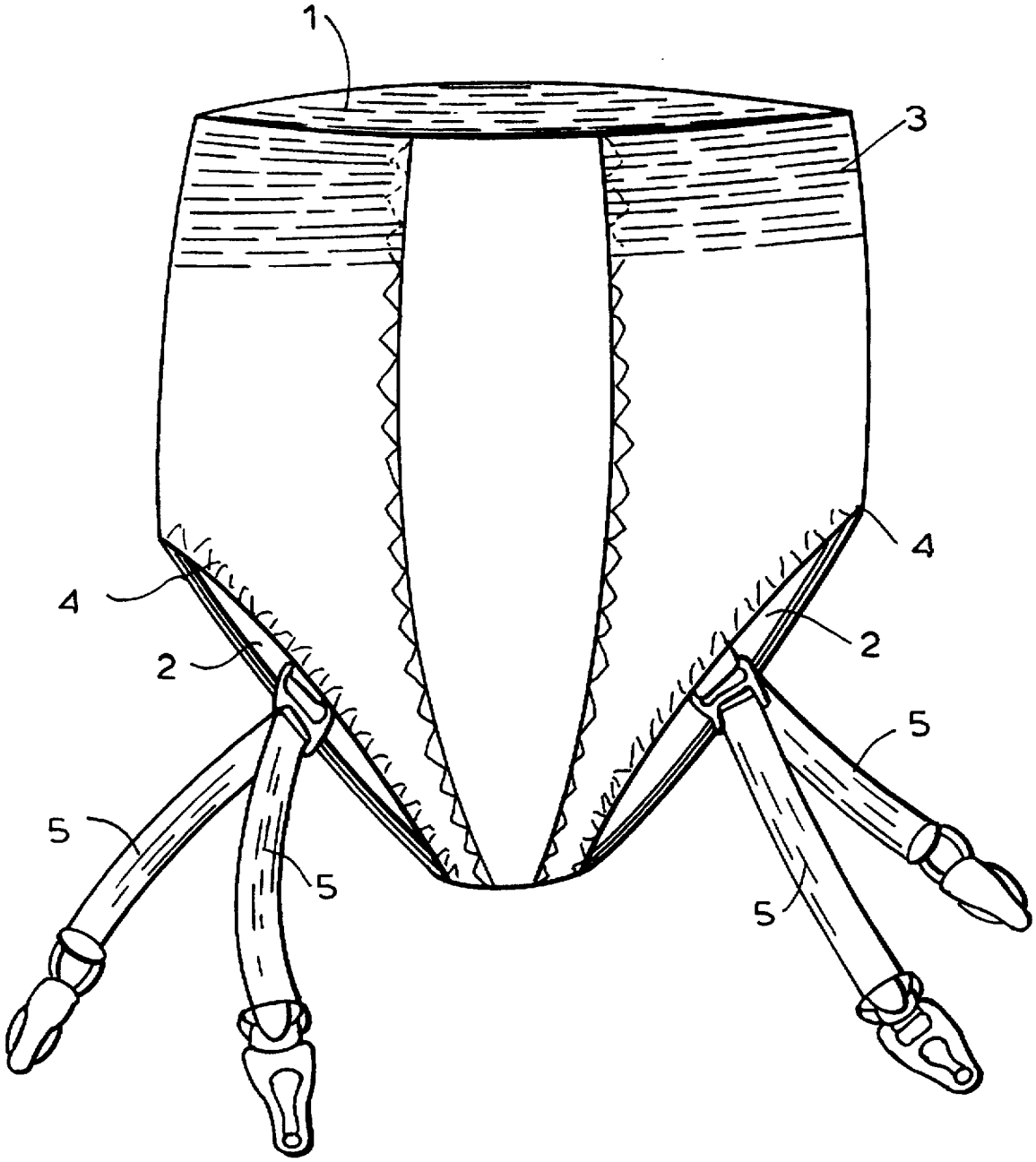
FIG. 8 PRIOR ART
FIG. 8 is a front perspective view of a prior art undergarment.
Figure 9:
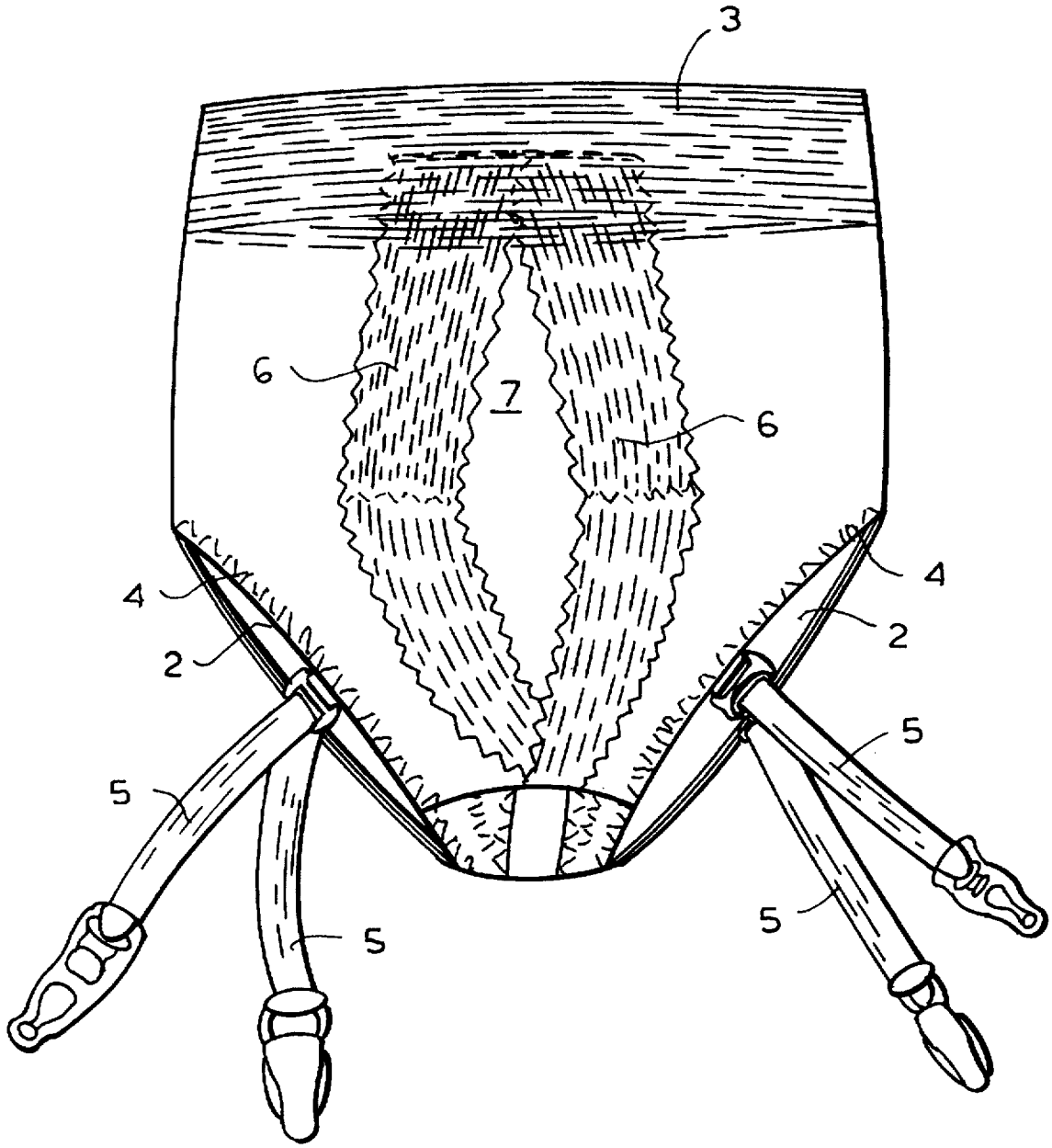
FIG. 9 PRIOR ART
FIG. 9 is a rear perspective view of the prior art undergarment shown in FIG. 8.

FIG. 7 shows the front fabric panel 10 and the back fabric panel 12 splayed out prior to assembly. The front fabric panel 10 preferably has a width that is longer than the width of the back fabric panel 12. Also, the front fabric panel 10 has a convex shaped hip opening 16 section, while the back fabric panel 12 has a concave shaped hip opening 16 section. When assembled, and worn on the wearer's body, the relatively longer front fabric panel 10 is effective for shaping the waistline and midsection of the wearer, while the back fabric panel 12 is disposed at the top portion of the buttocks of the wearer, and against the lower back of the wearer, so that the overall urging force of the inventive body shaping undergarment is effective to firm and shape the waistline and midsection of the wearer.

INDUSTRIAL APPLICABILITY

The present invention is particularly suitable for application to modern industrial processes. In particular, conventional garment manufacturing processes and materials can be used to provide the inventive body shaping undergarment described herein. While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. An undergarment, comprising: a front fabric panel and a back fabric panel fixed together to form an undergarment having a hollow-tubular shape open at a top end to define an open waist opening and open at a bottom end to define an open hip opening, the front fabric panel having a maximum width which, when the front fabric panel is unfolded and extended, is longer than a maximum width of the back fabric panel, when the back fabric panel is unfolded and extended; an elastic waist band disposed around a circumference of the waist opening and having an elasticity and width effective to constrain and shape the waistline of a wearer; and a pair of leg straps disposed at the hip opening, each leg strap having a first end fixed to the front fabric panel and a second end fixed to the back fabric panel, the pair of leg straps being disposable during use between legs and around a crotch area of a user so that said each leg strap extends from the front fabric panel, between the legs of the user, around the crotch area of the user and to the back fabric panel to retain the undergarment at a position against a waist and a mid-section of the user so that the front fabric panel, the back fabric panel and the elastic waist band co-act to shape the waist and mid-section of the user.

2. An undergarment according to claim 1, wherein the front fabric panel and the back fabric panel comprise an elastic fabric comprising 59% dull antron nylon, 23% mid dull antron nylon and 18% dull lycra.

3. An undergarment according to claim 1, wherein the width of the elastic waist band is at least one and one-half inches.

4. An undergarment according to claim 1, wherein the width of the elastic waist band is two inches.

5. An undergarment according to claim 1, wherein the pair of legs straps comprise and elastic material.

6. An undergarment according to claim 1, further comprising an elastic hip band disposed around a circumference of the hip opening for co-acting with the front fabric panel, the back fabric panel and the elastic waist band to shape the waist and mid-section of the user.

7. An undergarment, comprising: a front fabric panel and a back fabric panel fixed together to form an undergarment having a hollow tubular shape open at a top end to define an open waist opening and open at a bottom end to define an open hip opening, the front fabric panel having an unfolded extended width longer than that of the back fabric panel; an elastic waist band having a width of at least one and one-half inches and disposed around a circumference of the waist opening, the elastic waist band having an elasticity effective to constrain and shape the waistline of a wearer; a pair of elastic leg straps disposed at the hip opening, each elastic leg strap having a first end fixed to the front fabric panel and a second end fixed to the back fabric panel, the pair of elastic leg straps being disposable during use between legs and around a crotch area of a user so that said each elastic leg strap extends from the front fabric panel, between the legs of the user, around the crotch area of the user and to the back fabric panel to retain the undergarment at a position against a waist and a mid-section of the user; and an elastic hip band disposed around a circumference of the hip opening for co-acting with the front fabric panel, the back fabric panel and the elastic waist band to shape the waist and mid-section of the user.

8. An undergarment according to claim 7, wherein the front fabric panel and the back fabric panel comprise an elastic fabric comprising 59% dull antron nylon, 23% mid dull antron nylon and 18% dull lycra.

9. An undergarment according to claim 7, wherein the width of the elastic waist band is two inches.

* * * * *